US008763549B2

(12) United States Patent
Liu et al.

(10) Patent No.: US 8,763,549 B2
(45) Date of Patent: Jul. 1, 2014

(54) ADJUSTABLE AND DISCONNECTABLE SUBMERGED-YOKE MOORING SYSTEM

(75) Inventors: Yonghui Liu, Houston, TX (US); Cheng-Pen Kwei, Houston, TX (US)

(73) Assignee: SOFEC, Inc., Houston, TX (US)

( * ) Notice: Subject to any disclaimer, the term of this patent is extended or adjusted under 35 U.S.C. 154(b) by 429 days.

(21) Appl. No.: 12/966,874

(22) Filed: Dec. 13, 2010

(65) Prior Publication Data

US 2011/0139054 A1 Jun. 16, 2011

Related U.S. Application Data

(60) Provisional application No. 61/286,312, filed on Dec. 14, 2009.

(51) Int. Cl.
*B63B 21/00* (2006.01)
*B63B 21/50* (2006.01)

(52) U.S. Cl.
USPC ..... 114/230.15; 114/230.1; 114/230.14

(58) Field of Classification Search
USPC ..... 114/230.1, 230.13–230.19; 441/3–5
See application file for complete search history.

(56) References Cited

U.S. PATENT DOCUMENTS

| | | | | |
|---|---|---|---|---|
| 3,722,223 | A * | 3/1973 | Gratz | 405/219 |
| 4,176,615 | A * | 12/1979 | Reid et al. | 441/3 |
| 4,226,204 | A * | 10/1980 | Tuson | 441/3 |
| 4,516,942 | A | 5/1985 | Pedersen | |
| 4,530,302 | A * | 7/1985 | Pedersen | 114/230.15 |
| 4,825,797 | A | 5/1989 | Podervaart et al. | |
| 4,836,813 | A | 6/1989 | Poldervaart | |
| 6,227,135 | B1 * | 5/2001 | Pedersen | 114/230.15 |
| 6,439,147 | B2 * | 8/2002 | Cottrell et al. | 114/230.19 |
| 6,932,015 | B2 | 8/2005 | Storvoll et al. | |
| 2001/0029879 | A1 | 10/2001 | Cottrell et al. | |
| 2004/0094082 | A1 | 5/2004 | Boatman | |

FOREIGN PATENT DOCUMENTS

EP 1178922 B1 2/2002

OTHER PUBLICATIONS

PCT Written Opinion and Search Report of corresponding counterpart international application No. PCT/US2010/060104 dated Feb. 14, 2011.

* cited by examiner

*Primary Examiner* — Ajay Vasudeva
(74) *Attorney, Agent, or Firm* — Gary L. Bush; Andrews Kurth LLP

(57) ABSTRACT

A single point mooring includes a yoke-shaped articulated arm assembly, which is affixed to the seabed by a fixed foundation or mooring base assembly, and a mooring support structure, which is retrofitted to a vessel. The articulated arm is connected to the base by a triaxial articulation joint for accommodating yaw, pitch and roll. To moor the vessel, the arm is connected to the mooring support structure with weighted pendants on port and starboard sides. The pendants are suspended at an adjustable elevation with respect to the mooring support structure, thus allowing the mooring system to be used at varying water depths. A combined connection bracket hosts both pendant linkages and umbilicals or hoses for speeding the process of connecting and disconnecting a vessel from the mooring system. A removable anchor, such as a suction pile, fixes the mooring system to the seabed, allows the system to be easily redeployed to another location.

9 Claims, 5 Drawing Sheets

ADJUSTABLE AND DISCONNECTABLE SUBMERGED-YOKE MOORING SYSTEM

CROSS REFERENCE TO RELATED APPLICATION

This application is based upon provisional application 61/286,312 filed on Dec. 14, 2009, which is incorporated herein by reference and the priority of which is claimed.

BACKGROUND OF THE INVENTION

1. Field of the Invention

This invention relates generally to the technology of mooring vessels such as oil tankers, floating barges, FPSOs (floating, production, storage and offloading vessels), and the like, to a station where fluids may be transferred from a producing well or storage area to the vessel. In particular, the invention relates to a single point mooring system for vessels on a body of water.

2. Background Art

Single point mooring systems have frequently been used in offshore locations for the loading and unloading of hydrocarbons or other flowable cargos into or out of marine vessels such as tankers, FPSOs, barges and the like. Many such systems have been developed and are now in use for both loading and unloading hydrocarbons at offshore locations. Examples of such conventional systems include the catenary anchor leg mooring (CALM) apparatus and the single anchor leg mooring (SALM) apparatus.

The catenary anchor leg mooring system (CALM) holds a floating buoy by an array or pattern of anchors attached by mooring chains or lines. The vessel that is to be loaded is attached to the floating buoy by suitable mooring hawsers or a rigid mooring arm. In such a mooring system the position restoring mooring forces are provided by the horizontal force component in the mooring chains. However, in shallow water it has been difficult to arrange the mooring chains with sufficient slack to provide adequate resiliency or horizontal spring in the mooring system. In such instances, the horizontal movement of a moored vessel caused by external forces due to waves, winds and currents can cause sudden extremely large forces which may exceed the capacity of the mooring system to maintain the vessel in the hydrocarbon transferring mode.

Conventional single anchor leg mooring systems (SALM) have used one floating mooring buoy attached with a suitable chain or articulated arm to a lower base structure fixed to the sea bottom or floor. By adjusting buoy draft, a desired tension level is created in the anchor leg. The tension provides a constant restoring or horizontal urging force for resiliently mooring a floating vessel to the buoy. In shallow water the vessel position restoring capacity of the SALM mooring system is also reduced and not suitable for mooring large vessels. In general, the conventional SALM system has also not been particularly well suited for use in a location or region where large ice flows may contact or may be expected to impact the mooring buoy. Accordingly, a completely submerged mooring system that provides resiliency and restoring forces to a moored vessel is desirable.

U.S. Pat. No. 4,530,302 issued to Pedersen and U.S. Pat. No. 4,825,797 issued to Polfervaart et al., both incorporated herein by reference, disclose submerged single point mooring systems having a submerged mooring base on which a submerged yoke is pivotably mounted. The forked end of the yoke carries heavy weights and is connected to the vessel by way of vertical or near vertical suspension members connected to the bow of the vessel. Universal joints and/or triaxial articulation joints are included in the mooring system to allow the moored vessel to weathervane, roll, pitch and heave under the effects of current, wave, wind and tides. The heavy weights provide a self-actuating restoring force to the vessel.

However, the known submerged single point mooring systems of prior art do not readily lend themselves to adjustment for the widely varying depths of the shallow water mooring locations and are thus not particularly suitable for relocation from one mooring location to another.

3. Identification of Objects of the Invention

A primary object of the invention is to provide a mooring apparatus that can be adjusted for different water depths in shallow water.

Another object of the invention is to provide a mooring apparatus for shallow water applications that is independent of water depth.

Another object of the invention is to provide a shallow water mooring apparatus that can be easily retrieved and relocated.

Another object of the invention is to provide a mooring apparatus that can be quickly disconnected from and reconnected to a vessel for the avoidance of hurricanes, typhoons and other storms.

Another object of the invention is to provide a shallow water mooring apparatus that can be submerged at the seabed in a stowed position.

SUMMARY OF THE INVENTION

The objects described above and other advantages and features of the invention are incorporated, in a preferred embodiment, in a mooring system having a submerged mooring base on which is mounted a triaxial articulation assembly for connection of one end of a submerged yoke, the other end of the yoke being connected to the vessel by way of pendant linkages that are suspended at an adjustable elevation from a mooring support structure on the vessel. The submerged yoke is a unitary structure having a vee shape with the apex end of the vee being connected to the triaxial articulation assembly. The two open arms of the yoke are connected via universal joints to two parallel linkages, which in turn are attached via universal joints to one of a number of available pairs of connection points, each pair of connection points being located at a different elevation with respect to the vessel. Heavy weights are carried at the outward ends of the two yoke arms, resulting in large axial tension forces in the yoke suspension pendant linkages. As the pendant linkages become inclined as a result of wind, wave and current forces acting on the vessel, the horizontal component of the axial forces in the pendant linkages provides a self-actuating restoring force to the vessel.

Flexible conveying hoses extend from the vessel to the submerged mooring base for conveying the cargo to be loaded on the vessel or to be off loaded from the vessel.

The plurality of connection points at varying elevations along the mooring support structure of the vessel allow the mooring system to be used at varying water depths. By simply connecting the pendent linkages to the mooring support structure at an elevation which corresponds to a constant elevation above the seabed, the mooring system is water depth independent.

An optional combined connection bracket hosts both pendant linkages and umbilicals or hoses for speeding the process of connecting and disconnecting a vessel from the mooring system. A removable anchor, such as a suction pile, fixes the mooring system to the seabed, yet allows the system to be easily redeployed to another location.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
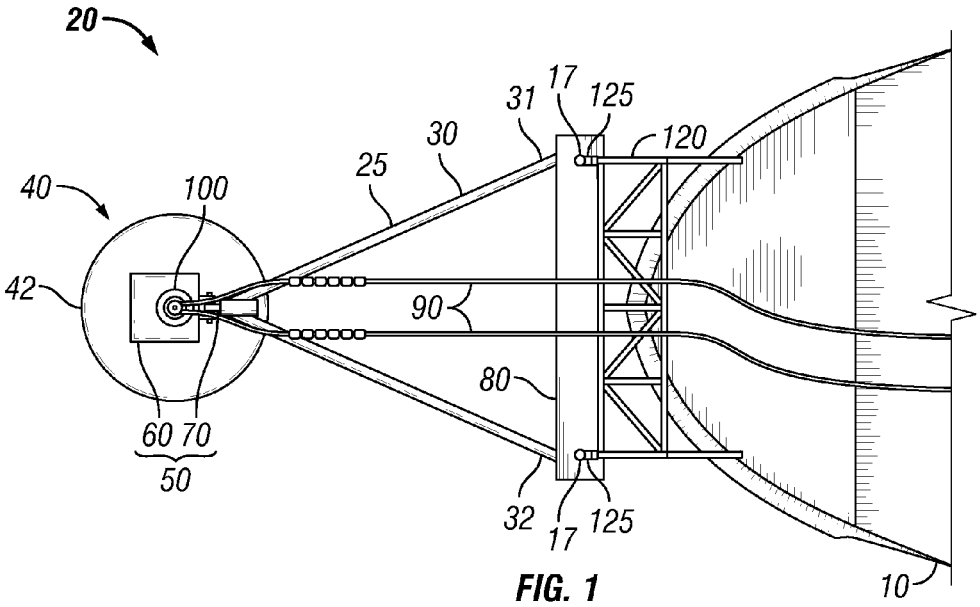
FIG. 1 is a plan view of a mooring system according to a first embodiment of the invention, showing a submerged yoke mooring system coupled to a vessel by a mooring support structure that is mounted to and carried by the vessel.
Figure 2:
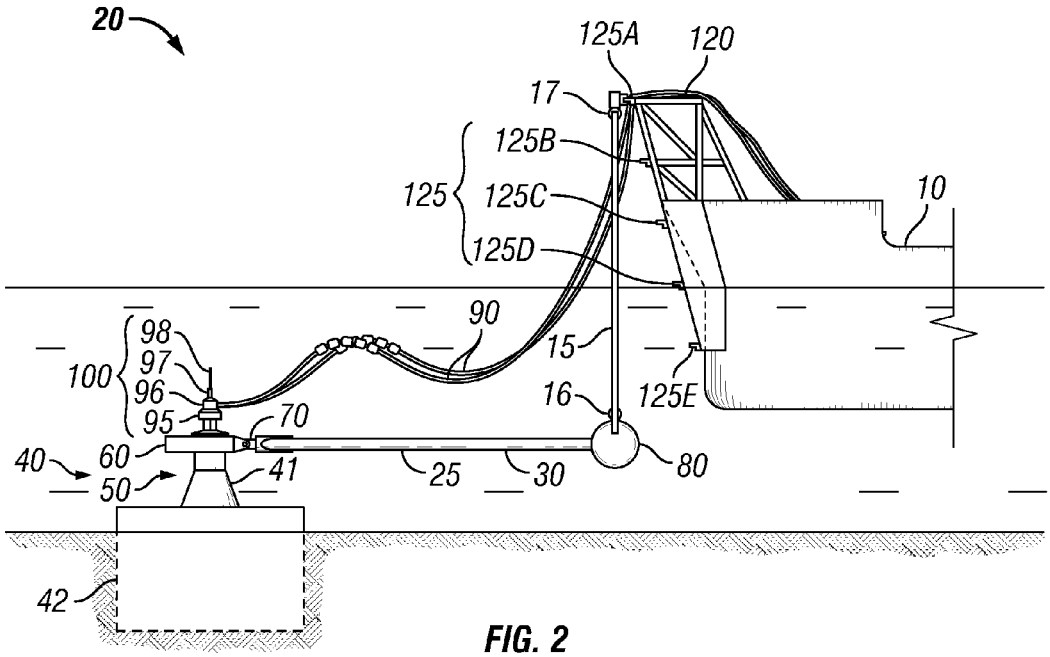
FIG. 2 is an elevation view of the mooring system of FIG. 1, in which the vessel is connected to the mooring system at a high connection point on the mooring support structure for mooring at a first shallow water depth.
Figure 3:
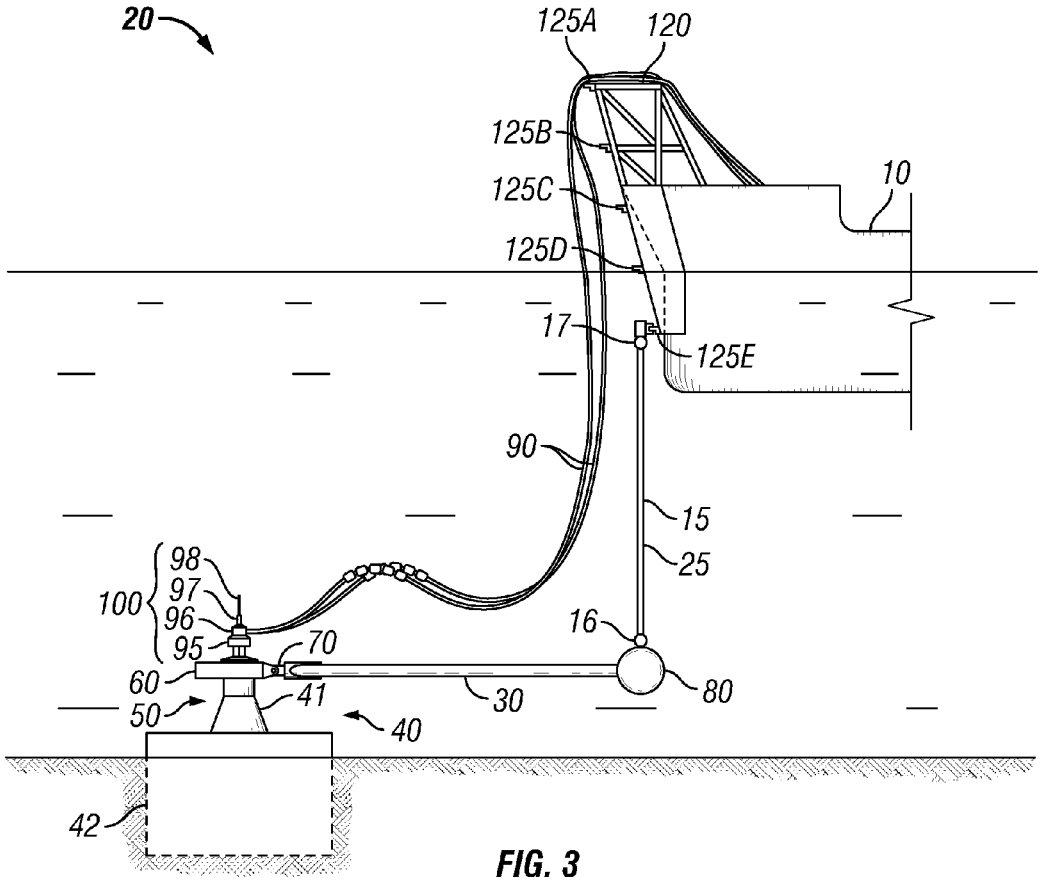
FIG. 3 is an elevation view of the mooring system of FIG. 1, in which the vessel is connected to the mooring system at a low connection point on the mooring support structure for mooring at a second shallow water depth which is twice as deep as the water depth of FIG. 2.
Figure 4:
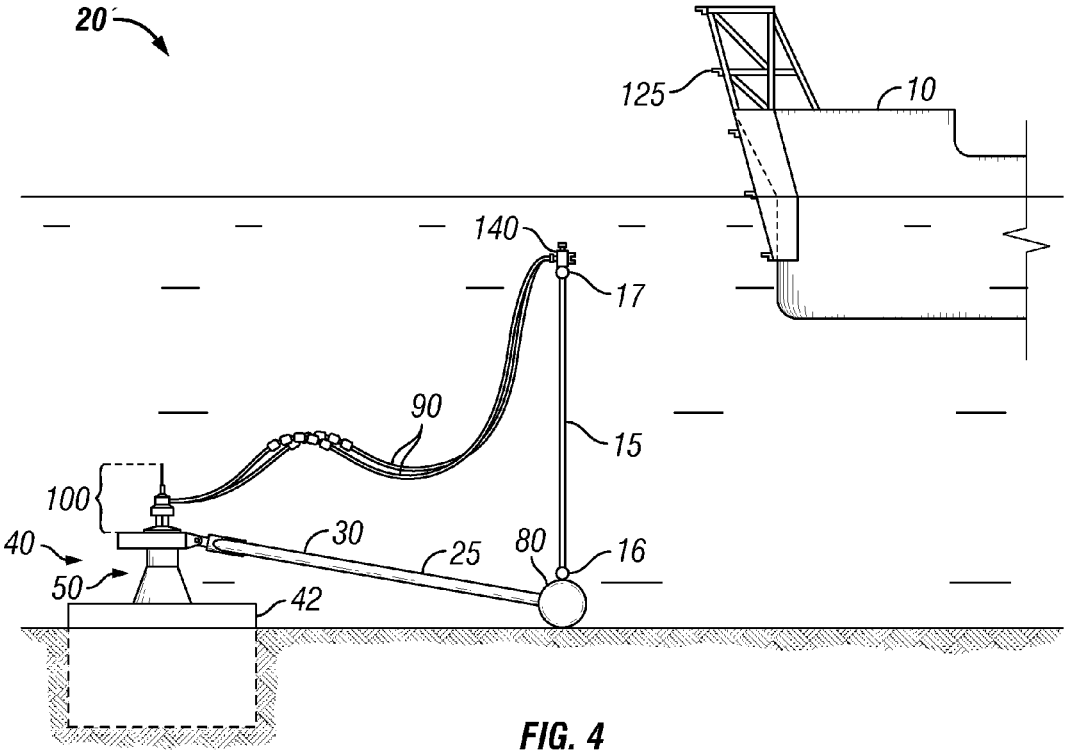
FIG. 4 is an elevation view of a mooring system according to a second embodiment of the invention, showing a floating combined bracket assembly that allows for quick disconnect of the mooring system from the vessel and stowage of the mooring system below the water's surface.

FIG. 1 is a plan view and FIGS. 2 and 3 are elevation views of a submerged single-point mooring apparatus 20 according to a preferred embodiment of the invention. Vessel 10, which may be a FPSO, FSO (floating storage and offloading), or other suitable vessel, is shown moored to a shallow-water adjustable and disconnectable mooring system 20, which accommodates different water depths. FIG. 2 illustrates the mooring apparatus 20 installed and in use at a water depth of 20 meters, and FIG. 3 illustrates the identical mooring apparatus 20 installed and in use at a water depth of 40 meters.

Mooring system 20 includes an articulated arm assembly 25, which is affixed to the seabed by a fixed foundation or mooring base assembly 40, and a mooring support structure (MSS) 120, which is retrofitted or otherwise attached to vessel 10. To moor vessel 10, articulated arm assembly 25 is connected to mooring support structure 120 at one of several connection points 125.

The fixed foundation assembly 40 has center king post 41 that supports articulated arm assembly 25. The bottom of king post 41 is extended to the mudline and connects into a removable anchor system 42, such as one or more suction piles or a gravity based structure. Removable anchor system 42 allows the mooring system 20 to be relocated to different locations.

Articulated arm assembly 25 preferably includes a triaxial articulation assembly 50, a yoke 30, and one or more pendant linkages 15. The triaxial articulation assembly 50, which allows vessel 10 to freely weathervane, includes a turntable structure 60 that is mounted on king post 41 and a yoke head 70 that connects turntable 60 to yoke 30. Turntable 60 is designed for 360 degree rotation about a vertical axis defined by king post 41. Yoke head 70 contains a two-axis universal joint. Together, turntable 60 and yoke head 70 allow vessel 10 to roll, pitch, and yaw relative to the fixed foundation 40. Details of a suitable triaxial articulation assembly 50 are shown in U.S. Pat. No. 4,530,302, issued to Pedersen on Jul. 23, 1985 and entitled "Submerged Single Point Mooring Apparatus," which is incorporated herein by reference in its entirety for all purposes.

A swivel stack 100 is disposed atop triaxial articulation assembly 50. Swivel stack 100 includes a production swivel 95 and may also include as appropriate a water injection swivel 96, a utility swivel 97, and an electrical and/or optical slip ring assembly 98. Flexible jumper hoses, risers, and umbilicals 90 are connected between swivel stack 100 and vessel 10 to transfer fluids, power and control signals. Alternatively, rigid piping with fluid transfer swivels and articulated joints may be provided.

Yoke 30 is connected to fixed foundation 40 by triaxial articulation assembly 50 (turntable 60 and biaxially-articulated yoke head 70). In plan view, yoke 30 may have the shape of a wye or vee, although other shapes may be used as appropriate. At each distal end of the yoke's forked tines 31, 32, a pendant linkage 15 is connected at its lower end by a triple-axis U-joint 16. Attached to mooring support structure 120, pendant linkages 15 hang generally vertically at the bow or stern of vessel 10. The upper end of each pendant linkages 15 is connected to MSS 120 by a double-axis U-joint 17.

The tines 31, 32 of yoke 30 also ideally carry one or more weights 80, which may be high density concrete blocks or the like that are sufficiently heavy so as to provide, as pendants linkages 15 are inclined, an adequate position-restoring force to vessel 10 to counteract vessel surge and heave.

Mooring support structure 120 is mounted at the bow or stern of vessel 10 and is designed to support the two pendant linkages 15 that connect to each end of yoke tines 31, 32. MSS 120 also provides hang-off points for the transfer hoses, risers and/or umbilicals 90 that hang between MSS 120 and turntable 60. MSS 120 includes a number connection points 125 to which pendant linkages 15 can be connected. In FIG. 2, the pendant linkages 15 are connected to an upper connection point 125*a*, and in FIG. 3, the pendant linkages 15 are connected to a lower connection point 125*e*. As can be seen by this difference between FIGS. 2 and 3, by appropriately selecting connection points 125, the same standard pendant link arms, yoke, risers/hoses and fixed foundation designs can be used for widely varying water depths. The submerged yoke mooring/riser system is thus water depth independent, requiring only a relatively simple adjustment to accommodate different depths.

Figure 5:
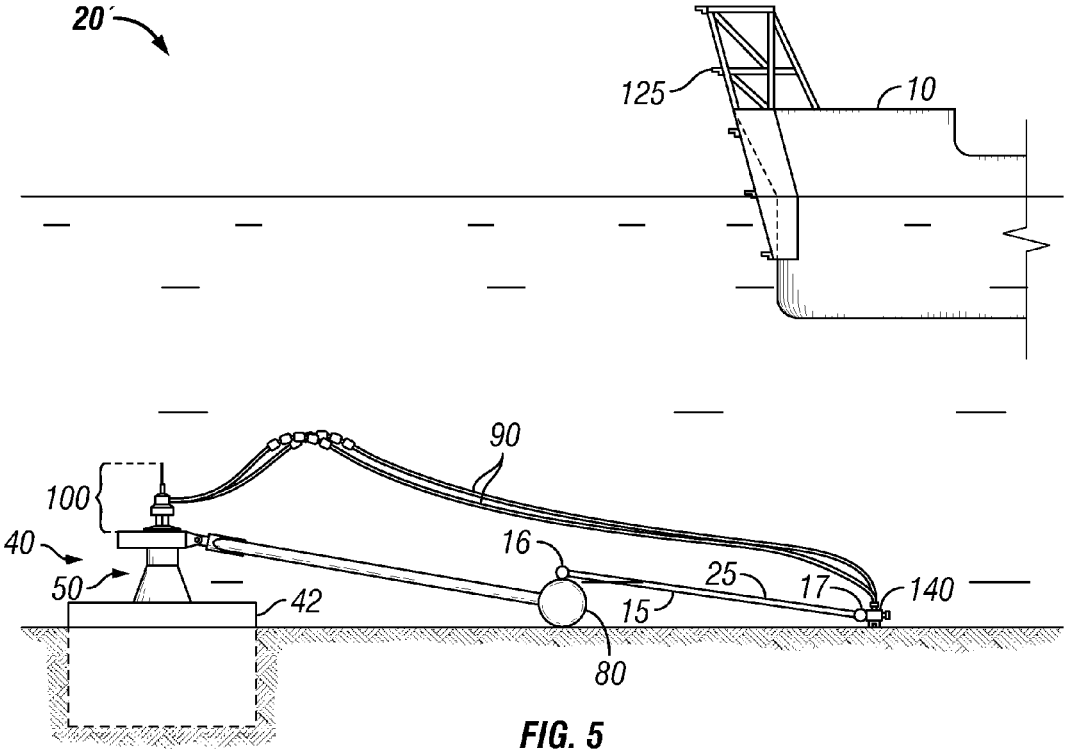
FIG. 5 is an elevation view of the mooring system according to a third embodiment of the invention, showing a sinking combined bracket assembly that allows for quick disconnect of the mooring system from the vessel and stowage of the mooring system at the seabed.
Figure 6:
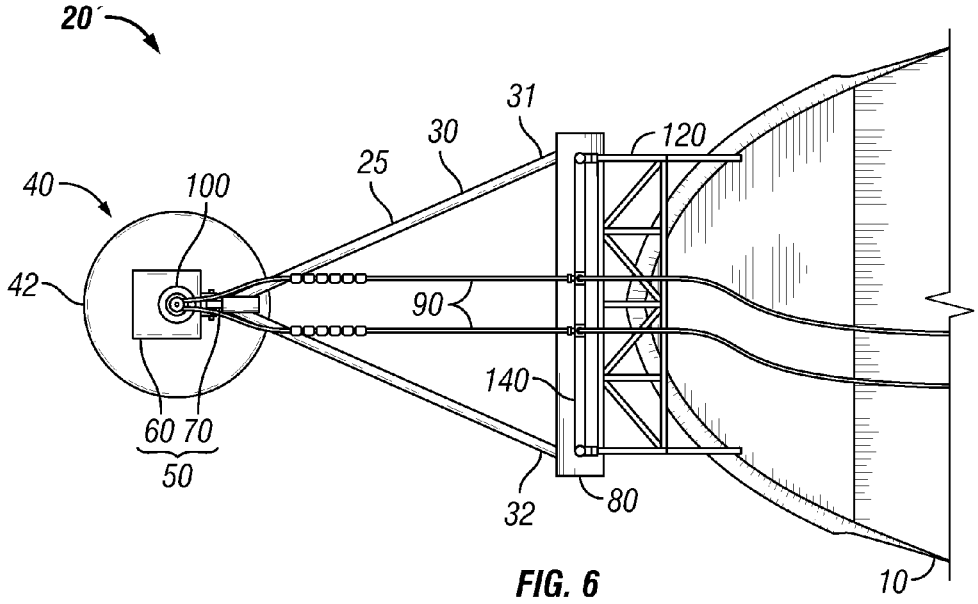
FIG. 6 is a plan view of the mooring system of FIG. 4 or FIG. 5, showing a combined bracket assembly for connecting to the vessels' mooring support structure that also carries fluid transfer hoses.
Figure 7:
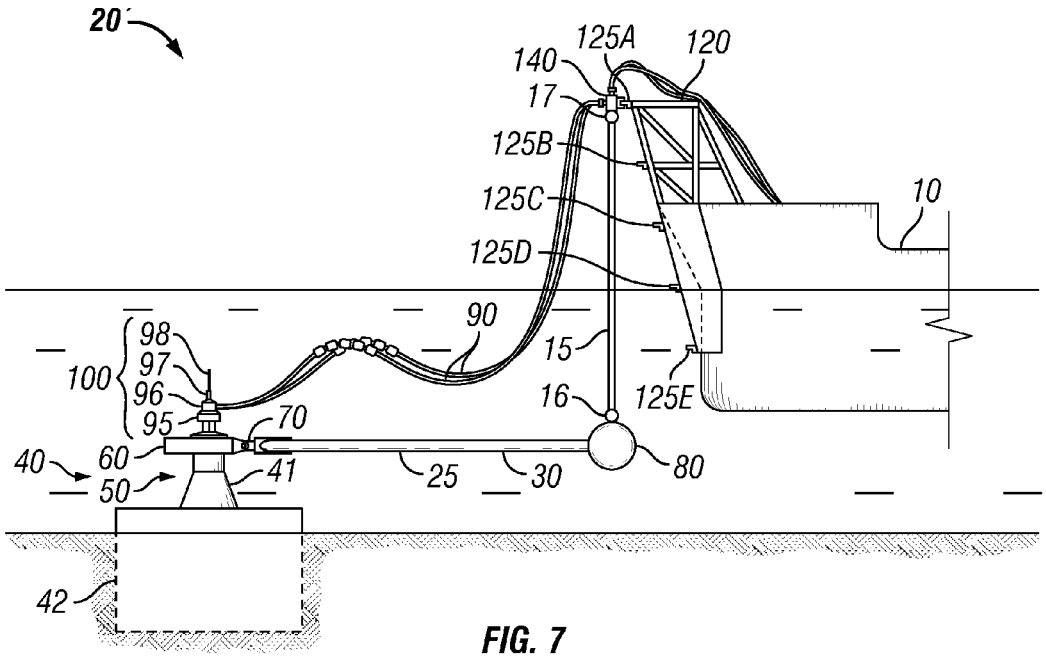
FIG. 7 is an elevation view of the mooring system of FIG. 6, in which the vessel is connected to the mooring system by a combined bracket assembly at a high connection point on the mooring support structure for mooring at a first shallow water depth.
Figure 8:
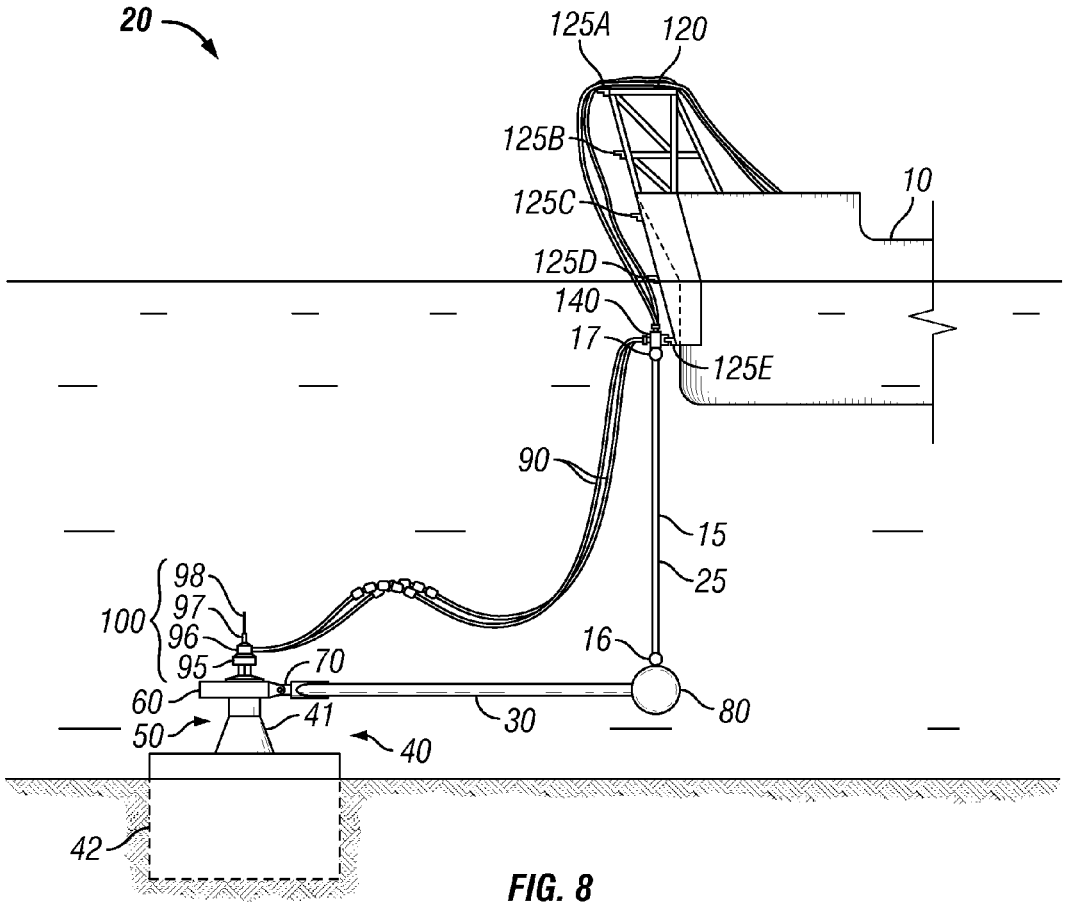
FIG. 8 is an elevation view of the mooring system of FIG. 6, in which the vessel is connected to the mooring system by a combined bracket assembly at a second shallow water depth which is twice as deep as the water depth of FIG. 7.

FIGS. 4-8 illustrate an alternative mooring system 20' in which a combined bracket assembly 140 or similar structure is provided to carry the upper universal U-joints 17 of both pendant linkages and all riser, hoses, umbilicals 90, etc. Combined bracket assembly 140 mounts directly to an appropriate connection point 125, or pair of connection points 125, on MSS 120 (FIGS. 2 and 3). Combined bracket assembly 140 may thus speed the process of connecting or disconnecting vessel 10. For example, combined bracket assembly 140 is disconnected from the mooring support structure of the vessel during sever typhoon/hurricane conditions and lowered into the ocean, where it either floats (FIG. 4) or sinks to the seabed (FIG. 5). After the severe weather has passed, the combined bracket assembly 140 is reconnected to the vessel's MSS 120 (FIGS. 6-8).

As illustrated herein, according to one or more embodiments of the invention, a triaxial articulation assembly 50 allows yoke 30 to accommodate yaw, pitch and roll motions of the vessel 10 with respect to mooring base 40. Pendant linkages 15 connect the outer ends of yoke tines 31, 32 to mooring connection points 125 at an appropriate elevation on the vessel's mooring support structure 120. The weighted yoke, universal joints, and triaxial articulation of articulated arm assembly 25 combine provide a resilient position restoring force to vessel 10 while allowing the moored vessel to surge, heave, sway, pitch, yaw and roll in response to wind, wave and current forces. Thus, a submerged, shallow-water mooring system 20' that is adjustable for different water depths, that is quickly disconnected and reconnected to the vessel 10, and that is easily retrieved and relocated is provided.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A mooring system (20) for mooring a vessel (10) in a body of water comprising:

a mooring support structure (120) connected to one of the group consisting of a bow and a stem of said vessel (10), said mooring support structure (120) disposed at least partially outboard of said vessel (10) and including a plurality of connection elevation points (125A . . . 125E) located at differing elevations, a connection assembly (30) having one end rotatably coupled between a submerged base assembly (40) and one of said connection elevations points (125A . . . 125E) of said mooring support structure (40), said connection assembly (30) having a first arm (25) rotatably coupled at one end to said submerged base assembly (40) and a second end rotatably coupled to a lower end of a linkage (15) which has an upper end disconnectably coupled at one of said connection elevation points (125A . . . 125E) of said mooring support structure (120);

whereby said linkage (15) is arranged to be oriented substantially vertically from said mooring support structure (120) of said vessel (10) by disconnecting said upper end of said linkage (15) from one connection elevation point to another connection elevation point depending on water depth in which said vessel (10) is moored.

2. The mooring system (20) of claim 1 wherein:

said base assembly (40) is anchored to the seafloor of said body of water; and said first arm (25) is coupled to said submerged base assembly (40) by a triaxial articulation assembly (50).

3. The mooring system (20) of claim 2 wherein:

said base assembly (40) includes a king post (41);

said triaxial articulation assembly (50) includes a turntable (60) revolvably mounted on said king post (41) so as to provide 360 degree rotation about said king post (41); and said triaxial articulation assembly (50) includes a two-axis universal jointed yoke head (70) connecting said turntable (60) to said first arm (25).

4. The mooring system (20) of claim 2 further comprising:

weights (80) carried by said connection assembly (30).

5. The mooring system (20) of claim 1 wherein:

said connection assembly (30) has a second arm (25) having a first end rotatably connected to said submerged base assembly (40), said first and second arms (25) forming a yoke (30), and a second linkage (15) is rotatably coupled to a second end of said second arm (25) with the upper end of said first linkage (15) and with said second end of said second linkage (15) each rotatably connected to connection elevation points (125A . . . 125E) of the same elevation of said mooring support structure (120) via respective U-joints (17).

6. The mooring system (20) of claim 5 wherein:

said second end of said first arm (25) and said second end of said second arm (25) are each connected respectively to said lower ends of said first and second linkages (15) by a triple axis U-joint (16).

7. The mooring system (20) of claim 5 wherein:

said mooring system (20) further includes bracket assemblies (140) carrying said upper end of said first linkage (15) and an upper end of said second linkage (15), said bracket assembly (140) connectable to one of connection elevation points (125A . . . 125E).

8. The mooring system (20) of claim 7 wherein:

said bracket assembly (140) supports at least one member (90) from the group consisting of a riser, a hose, and an umbilical.

9. An apparatus (20)for mooring a vessel (10) comprising:

a submerged mooring base (40) secured to the floor of the body of water;

a submerged yoke (30) attached at its first end to the mooring base (40) by a triaxial articulation joint (50) for allowing the yoke (30) to move in yaw, pitch, and roll with respect to the submerged mooring base (40);

suspension linkages (15) connected between a submerged second end of the yoke (30) and a mooring support structure (120) mounted on the vessel (10); and weights (80) carried by a second end of the yoke (30) for providing a restoring force to the vessel (10) with respect to the mooring base (40);

said mooring support structure (120) including a plurality of connection elevation points (125A . . . 125E) at a plurality of elevations on said vessel (10) each arranged for connecting to and suspending one of said suspension linkages (15);

whereby said plurality of connection elevation points (125A . . . 125E) is arranged to be used to selectively connect said suspension linkages (15) in a substantially vertical orientation to at least one of said connected elevation points to provide adjustment of said apparatus (20) for varying water depth of said vessel (10).

* * * * *